US012503811B2

(12) United States Patent
Gray et al.

(10) Patent No.: US 12,503,811 B2
(45) Date of Patent: Dec. 23, 2025

(54) PORTABLE STEAMER DEVICE WITH COOLING FEATURE

(71) Applicant: DUPRAY VENTURES INC., Montreal (CA)

(72) Inventors: Brent Gray, Montreal (CA); Michel Morand, Verdun (CA); Guillaume Cavalie, Montreal (CA)

(73) Assignee: DUPRAY VENTURES INC., Montreal (CA)

( * ) Notice: Subject to any disclaimer, the term of this patent is extended or adjusted under 35 U.S.C. 154(b) by 154 days.

(21) Appl. No.: 18/256,560

(22) PCT Filed: Dec. 10, 2021

(86) PCT No.: PCT/CA2021/051781

§ 371 (c)(1),
(2) Date: Jun. 8, 2023

(87) PCT Pub. No.: WO2022/120493

PCT Pub. Date: Jun. 16, 2022

(65) Prior Publication Data

US 2024/0093423 A1 Mar. 21, 2024

Related U.S. Application Data

(60) Provisional application No. 63/123,579, filed on Dec. 10, 2020.

(51) Int. Cl.
*D06F 73/00* (2006.01)
*D06F 87/00* (2006.01)

(52) U.S. Cl.
CPC ..... *D06F 73/00* (2013.01); *D06F 87/00* (2013.01)

(58) Field of Classification Search
None
See application file for complete search history.

(56) References Cited

FOREIGN PATENT DOCUMENTS

| | | |
|---|---|---|
| CA | 2362092 A1 | 5/2002 |
| CN | 111472156 A | 7/2020 |

OTHER PUBLICATIONS

CN111472156A Espacenet machine translation, Steam device and operation and use method thereof, Cheng (Year: 2020).*
CN111472156A Clarivate Analytics machine translation, Steam device and operation and use method thereof, Cheng (Year: 2020).*
PCT Notification of Transmittal of the International Search Report and the Written Opinion of the International Searching Authority, or the Declaration; International Application No. PCT/CA2021/051781; International Filing Date: Dec. 10, 2021; Date of Mailing: Feb. 28, 2022; pp. 1-9.

* cited by examiner

*Primary Examiner* — Cristi J Tate-Sims
(74) *Attorney, Agent, or Firm* — CANTOR COLBURN LLP

(57) ABSTRACT

A portable steamer device may include a casing, and a heater in the casing, the heater configured for heating liquid into steam. One or more nozzles are configured for exhausting steam from the heater. A volume is defined fined between a wall of the casing and the heater. A liquid conduit has a cooling segment passing through the volume and in fluid communication with the heater, the liquid conduit configured to feed liquid to the heater. The cooling segment of the liquid conduit is a thermal barrier configured to capture heat in the volume with liquid passing through the liquid conduit toward the heater.

20 Claims, 22 Drawing Sheets

PORTABLE STEAMER DEVICE WITH COOLING FEATURE

CROSS REFERENCE TO RELATED APPLICATIONS

This application is a National Stage application of PCT/CA2021/051781, filed Dec. 10, 2021, which claims the benefit of U.S. Provisional Application No. 63/123,579, filed Dec. 10, 2020, both of which are incorporated by reference in their entirety herein.

TECHNICAL FIELD

The present application relates to portable steamer devices, such as hand-held garment steamers of the type used with hanging clothes and textiles.

BACKGROUND

Portable steamer devices are commonly used to provide users with a hand-held source of steam to effect various tasks. As an example, garment steamers are commonly used for cleaning and/or sanitizing clothes, textiles, fabrics. A user typically manipulates a hand-held unit at the end of which steam is projected by nozzles. The steam produced by the garment steamers is jetted onto clothes so as to deodorize, disinfect or otherwise clean the clothes. Garment steamers may also be useful in removing crumples in clothes. Likewise, portable hand-held steamer devices may be configured in different ways to assist a user with cleaning tasks. For example, portable steamer devices may have one or more nozzles near a tool head to outlet steam as a washing or cleaning task is performed, such as brushing, scrubbing, wiping, etc.

Such portable steamers are typically compact to be easily manipulated. It is therefore common to have a heating element near the nozzles in such designs. However, a downside of such a configuration is that the heating element may be in close proximity to a handle of the portable steamer, and thus to the hand of the user. To distance the heating element from the handle, portable steamers may have an increased size, rendering the portable steamers less portable and/or less compact. It is therefore not uncommon to see users of portable steamers working with gloves. It would be desirable to design a portable steamer that addresses such issue.

SUMMARY

In one aspect, there is provided a portable steamer device comprising: a casing, a heater in the casing, the heater configured for heating liquid into steam, at least one nozzle, the at least one nozzle configured for exhausting steam from the heater, a volume defined between a wall of the casing and the heater, and a liquid conduit having a cooling segment passing through the volume and in fluid communication with the heater, the liquid conduit configured to feed liquid to the heater, whereby the cooling segment of the liquid conduit is a thermal barrier configured to capture heat in the volume with liquid passing through the liquid conduit toward the heater.

Still further in accordance with the aspect, for example, the casing defines a grip and a nozzle portion.

Still further in accordance with the aspect, for example, the volume is substantially located in the nozzle portion.

Still further in accordance with the aspect, for example, a detent may project from the casing and actuatable to cause a liquid flow in the liquid conduit.

Still further in accordance with the aspect, for example, the detent is mounted to the grip of the casing.

Still further in accordance with the aspect, for example, the volume is above a zone located forward of the detent.

Still further in accordance with the aspect, for example, a pump may be in the casing, the liquid conduit being between the pump and the heater.

Still further in accordance with the aspect, for example, the cooling segment defines at least 50% of a total length of the liquid conduit.

Still further in accordance with the aspect, for example, the cooling segment forms a hoop.

Still further in accordance with the aspect, for example, the volume is around the heater, and the cooling segment surrounds the heater.

Still further in accordance with the aspect, for example, a distance between the wall and the heater at the volume is between 0.125" and 0.5".

Still further in accordance with the aspect, for example, including a reservoir may be present.

Still further in accordance with the aspect, for example, the reservoir is releasably detachable from the casing.

Still further in accordance with the aspect, for example, a plurality of the at least one nozzle may be arranged in at least one row.

Still further in accordance with the aspect, for example, a plate may cover the at least one nozzle.

Still further in accordance with the aspect, for example, the portable steamer device is a garment steamer device.

Still further in accordance with the aspect, for example, a single one of the nozzle is provided, the nozzle configured for the attachment of an accessory.

In accordance with another aspect, there is provided a method for operating a portable steamer device comprising: actuating a heater configured to heat liquid into steam; supplying liquid to the heater, wherein supplying liquid to the heater includes passing the liquid through a volume located between the heater and an outer wall of the portable steamer device for liquid to reclaim heat from the heater; and exhausting steam from the heater.

Further in accordance with the other aspect, for example, passing the liquid through the volume includes circulating liquid in a segment of a liquid conduit.

Still further in accordance with the other aspect, for example, supplying liquid includes operating a pump.

Still further in accordance with the other aspect, for example, passing the liquid through the volume includes circulating in a segment of a liquid conduit extending from the pump to the heater.

Still further in accordance with the other aspect, for example, circulating liquid in the segment of the liquid conduit includes circulating liquid in at least 50% of a total length of the circuit.

DESCRIPTION OF THE DRAWINGS

Reference is now made to the accompanying figures in which.

DETAILED DESCRIPTION

Figure 1:
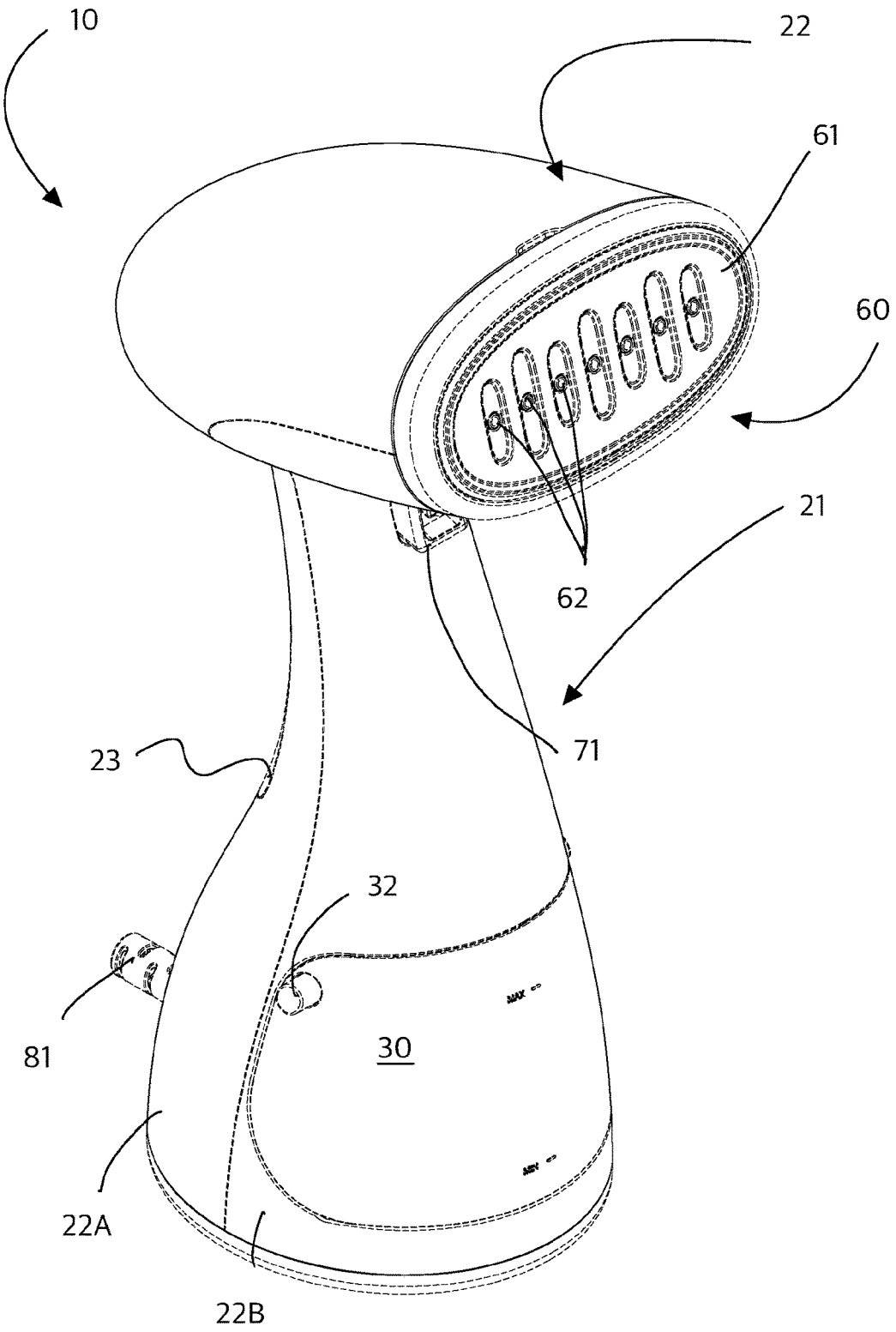
FIG. 1 is a perspective view of a garment steamer device in accordance with the present disclosure.
Figure 2:
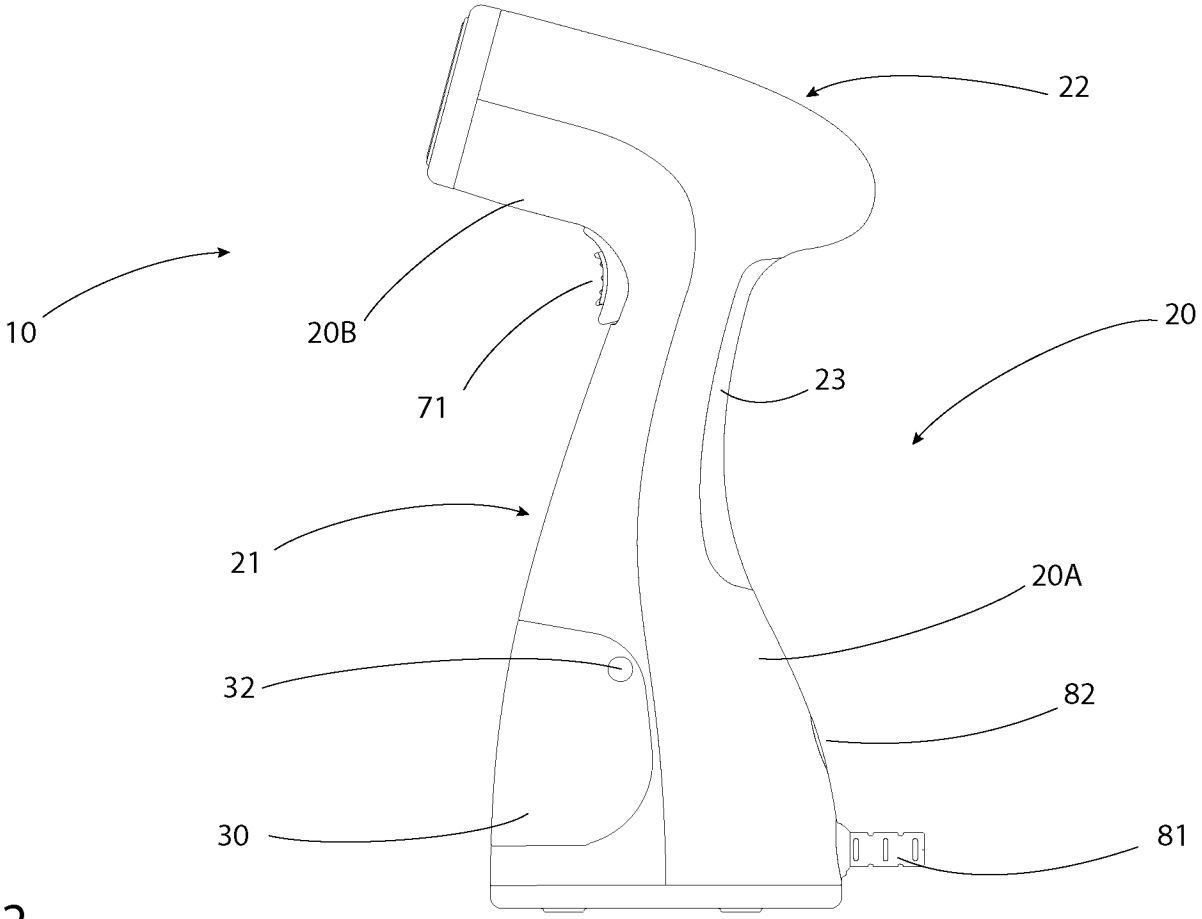
FIG. 2 is a side elevation view of the garment steamer device of FIG. 1.
Figure 3:
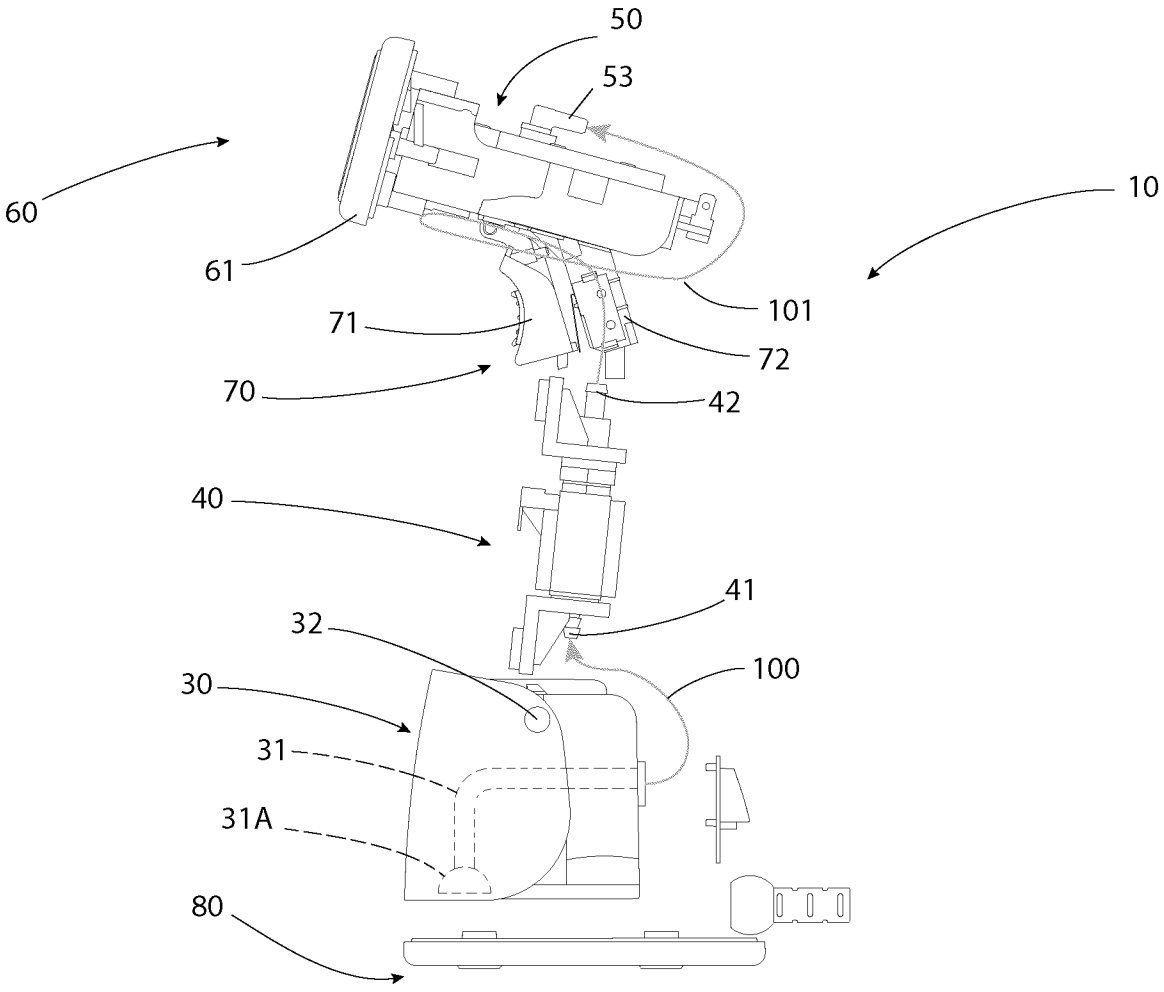
FIG. 3 is an assembly view of components of the garment steamer device of FIG. 1, with a casing thereof removed.

Referring to the drawings and more particularly to FIGS. 1 to 3, a garment steamer device in accordance with the present disclosure is generally shown at 10, and is one type of portable steamer devices that can benefit from cooling features described herein. Another portable steamer device is described hereinafter. The expression "portable" is used to describe the fact the devices described herein may be manipulated by a single hand of a user, or by a users hands, while steam is output by the device. Stated differently, portable may be equivalent to "hand held", and is representative of the manipulations of the devices described herein when generating and outputting steam. The garment steamer device 10 may also be known as a garment steamer, a clothes steamer, etc. The garment steamer device may be qualified as being portable, hand-held, compact, self-enclosed, among other possible monikers. Stated generally, the garment steamer device 10 heats a liquid such as water into steam, and may do so through electrical power, with resistive elements in direct heat exchange relation with a water circuit, or through a heat transfer fluid (e.g., oil), among other possibilities.

Referring to FIG. 3, the garment steamer device 10 may be described as having a casing 20 (FIG. 2), a liquid tank 30, a pump 40, a heating unit 50, an outlet head 60, a trigger assembly 70, a power system 80, and/or various water conduits in the 100*s*. The garment steam device 10 may have all of these components and additional components, or fewer components than the ones listed above. For example, the garment steamer device 10 may not have a liquid tank 30 in the hand-held portion and may instead be in fluid communication with a liquid source.

From a general standpoint, the casing 20 encloses the various functional components of the water steamer device 10 and has ornamental features as well as ergonomic features. As the casing 20 encloses some functional components such as the heating unit 50, the casing 20 may have a protective or shielding role. The liquid tank 30 is the water recipient of the garment steamer device 10. The expression "water" is used herein, but other liquids may be present instead of water, such as a mixture of liquid and chemical agents. For simplicity, reference is made herein to water as being present in the liquid tank 30. Other ways to describe the tank 30 include a reservoir, a receptacle, a receiver, etc. In an embodiment, as shown, the liquid tank 30 may be removable from a remainder of the garment steamer device 10. The pump 40 is the motive force in the garment steamer device 10, and is used to direct the liquid from the tank 30 to the heating unit 50. The heating unit 50 converts electrical power into heat so as to boil the liquid into steam. The outlet head 60 forms a protective shield for the heating unit 50 and may assist in directing steam out of the garment steamer device 10. The trigger assembly 70 is triggered by a user to control the output of steam out of the garment steamer device 10. The power system 80 interfaces the garment steamer device 10 to a power source such as the grid. The various water conduits labelled in the 100*s* fluidly connect the liquid tank 30, the pump 40 and the heating unit 50. Moreover, the water conduits 100*s* provide the cooling feature to the garment steamer device 10.

Figure 6:
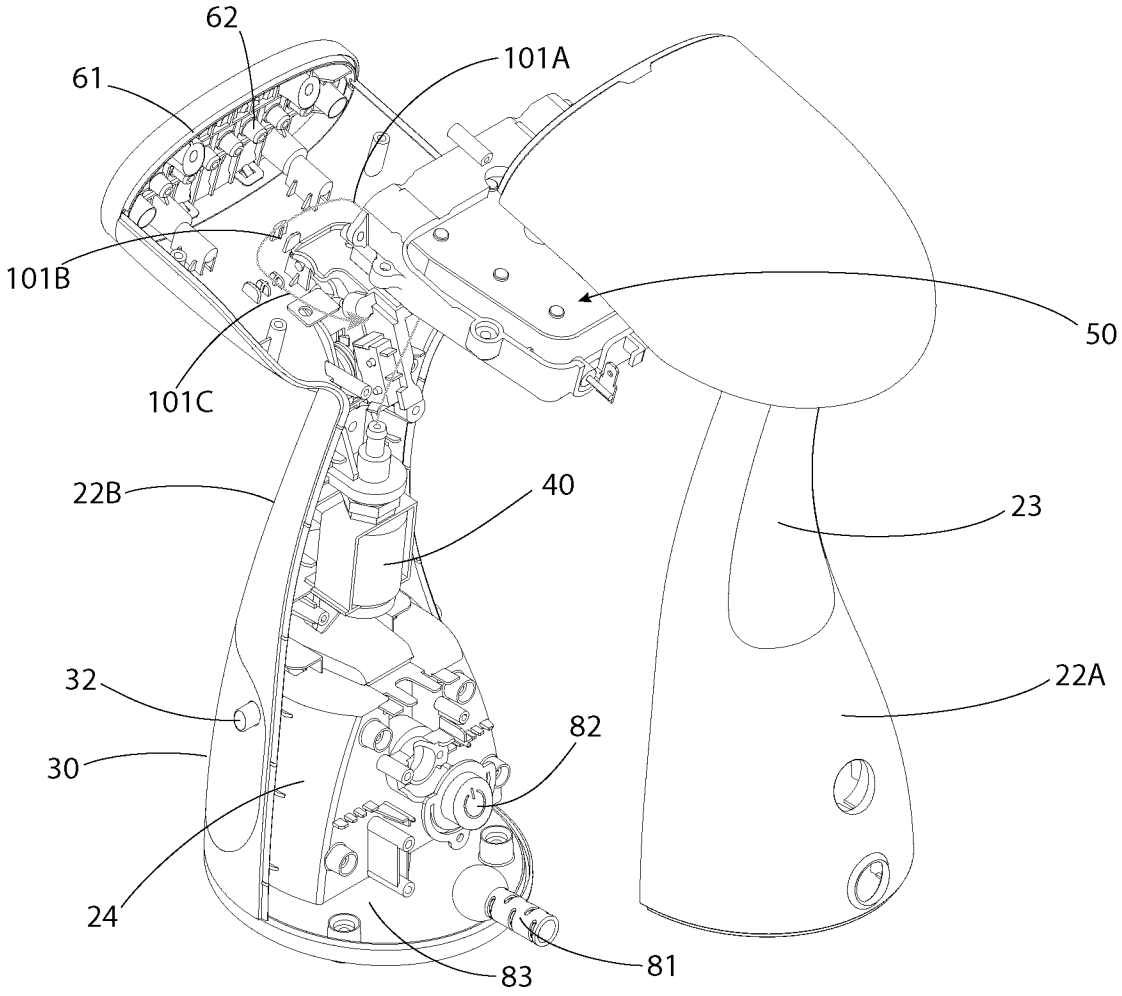
FIG. 6 is an assembly view of the garment steamer device of FIG. 1, showing an interior thereof.
Figure 7:
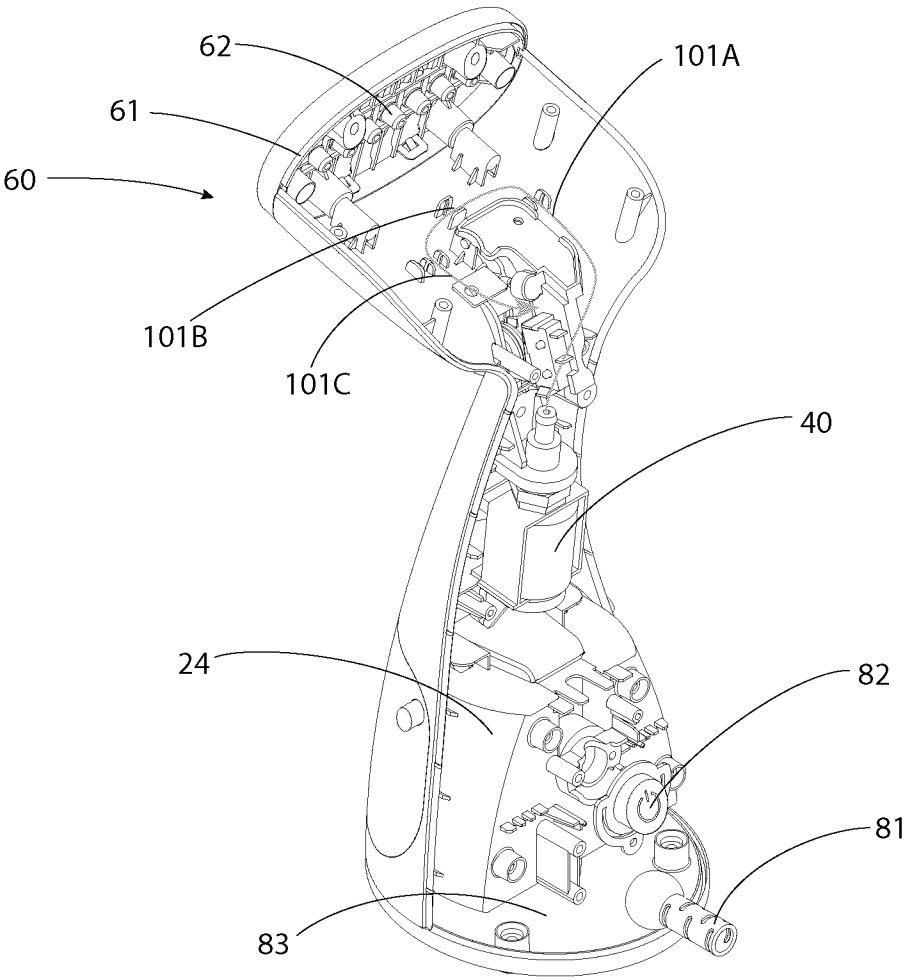
FIG. 7 is a further perspective view of the garment steamer device of FIG. 1, showing a cooling segment of a water conduit.

Referring concurrently to FIGS. 1, 2 and 6, the casing 20 is constituted of two interconnected shells shown respectively as 20A and 20B in FIG. 6. The shells 20A and 20B may be made of a plastic, among other possibilities, notably due to the low heat transfer capability of plastic in comparison to some metals. Other materials, including metal and natural materials, may be used. The plastic shells may be integrally molded so as to each be a monoblock piece. Other configurations are considered as well.

The casing 20 is shown having a gun-like or scanner-like shape, i.e., with a grip 21 and a nozzle portion 22 projecting forwardly from the grip portion 21. The grip 21 may also be known as a grip portion, as a handle, handle portion, etc. The garment steamer device 10 is manipulated via the grip 21. In use, the user's hand typically surrounds the grip 21 in similar fashion to the holding of a hand gun. Nozzle portion 22 is generally transverse to the grip 21. The nozzle portion 22 has at a distal end the outlet feature(s) of the garment steamer device 10, i.e., the component(s) through which steam is exhausted out of the garment steamer device 10.

Figure 9:
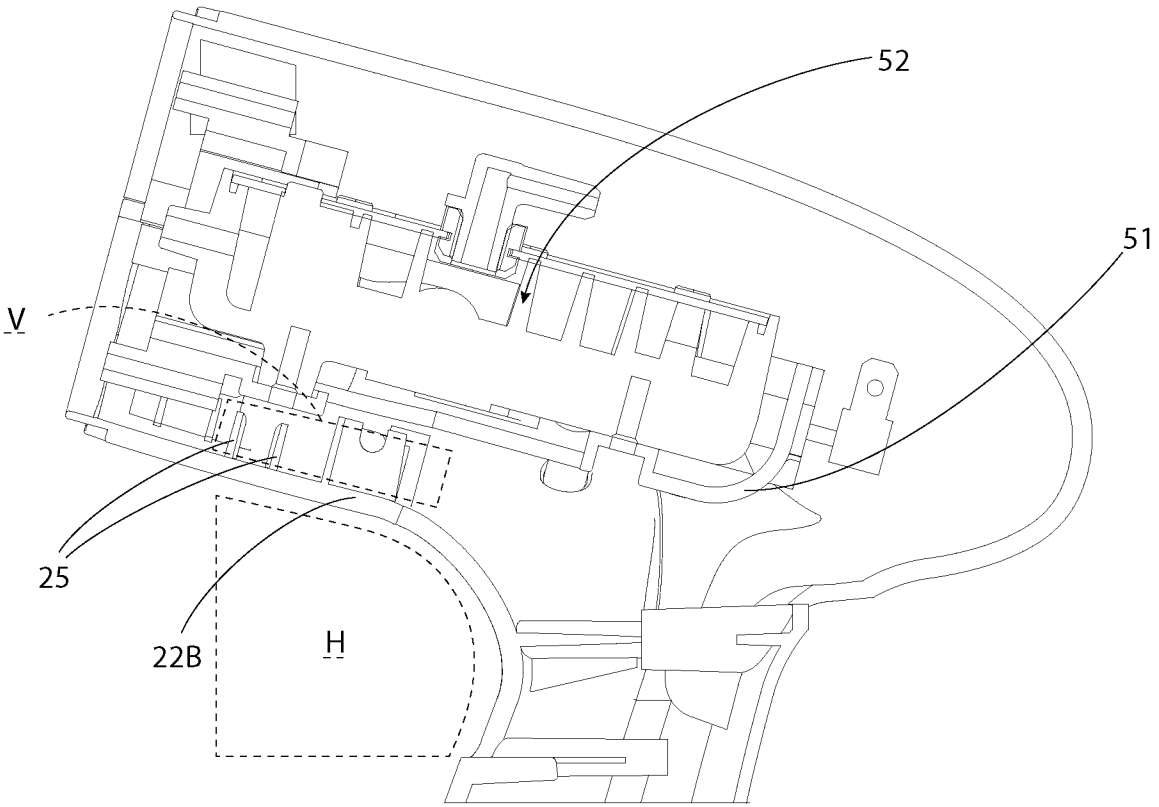
FIG. 9 is an enlarged elevation view of the garment steamer device, showing the location of the cooling segment.
Figure 10:
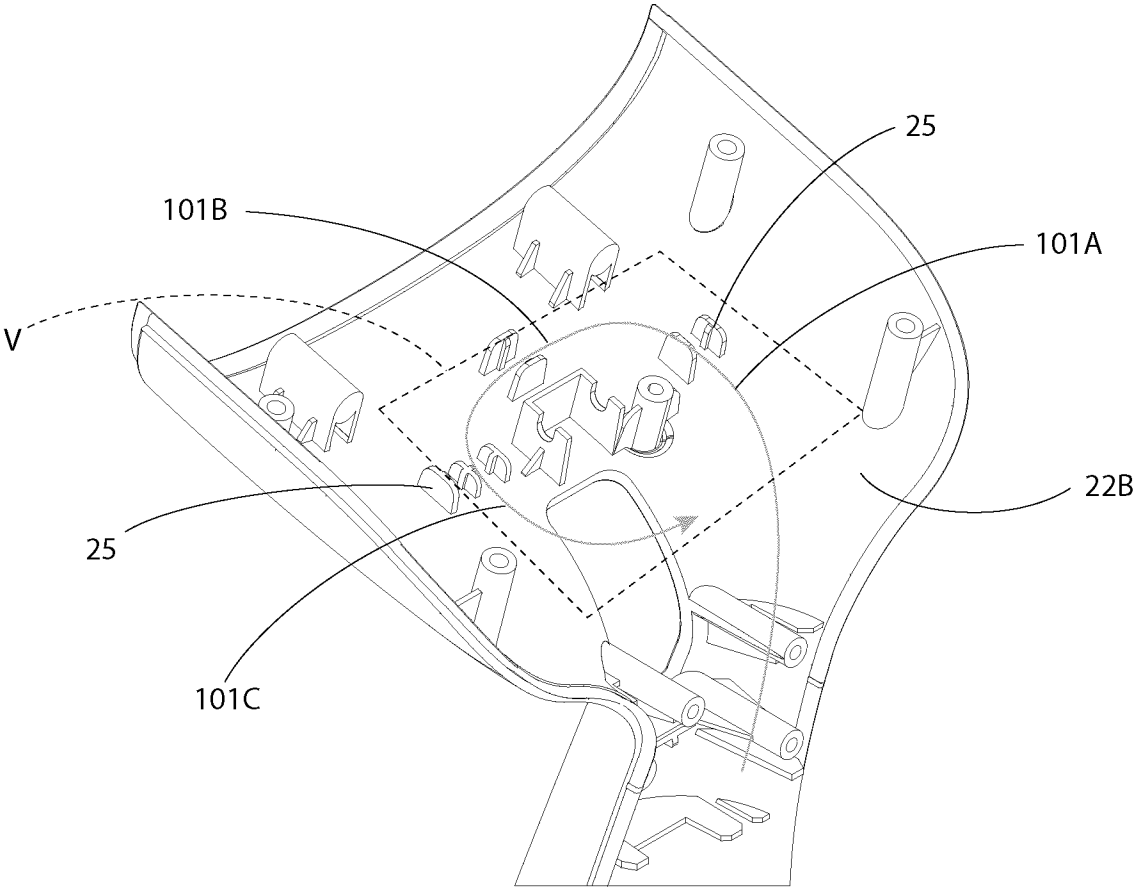
FIG. 10 is an enlarged perspective view of a shell of the casing showing the location of the cooling segment.

Other features may be present in the casing 20, including various supports for interconnecting the shells 20A to 20B, an insulation pad 23 near a junction between the grip 21 and the nozzle portion 22, etc. In an embodiment, the insulation pad 23 is cork, though other materials may be used. It can be seen in FIG. 6 that a boss 24 may be present in the shell 20A and is shaped so as to define a cavity that may receive the tank 30 therein, as a possible configuration among others. These features and other features may be present as well. For instance, the boss 24 could be a reservoir integrated into the casing 20. As shown in FIGS. 9 and 10, the casing 20 may have upwardly projecting fingers 25. The fingers 25 may be referred to as tongues, gates, posts, etc. In an aspect, the fingers 25 are integrally molded with the shell 20B. The fingers 25 may be in pairs, to define a guiding path/retaining feature for water conduit, as explained below. Such fingers or other retaining means may be parts of other components of the device 10.

Referring to FIGS. 2 and 3, the tank 30 is shown as being a removable component of the casing 20, though the tank 30 could be fixed to the casing 20 as well, if such a tank is present. The tank 30 is shown as part of the device 10, but only as an example as it is contemplated to connect the device 30 a water supply line, for example, or to have a liquid tank 30 separate from the hand-held device 10. In an aspect, the tank 30 is made of or has a transparent material or of a translucent material such that a user may see the level of liquid in the tank 30. As alternatives, a window(s) could be present in the tank 30, again to show the level of liquid in the tank 30, or an electronic level probe could be on the device 10 to provide data indicate of a level of water in the tank 30. For example, the probe could be connected to a LED or like interface to indicate to the user that the tank 30 must be refilled.

The tank 30 is shown as integrating a feed tube 31. The feed tube 31 may be elbow-shaped, with other possibilities including a quarter-circle tube, a straight tube. The tank 30 may even be without a feed tube 31, with a water conduit from the conduits 100*s* feeding directly off of the tank 30 (e.g., a bottom of the tank 30), if the tank 30 is present. If the feed tube 31 is present in the tank 30, it may have a mass 31A adjacent to an inlet at a bottom of the tank 30, with the feed tube 31 being flexible. This flexibility and mass 31A are to ensure that the inlet of the feed tube 31 remains at the bottom of the tank 30, and always has a supply of water if water is present in the tank 30.

In an aspect, the tank 30 is removable. To achieve the removal, the tank 30 therefore may have latch devices 32. The latch devices 32 may be in a pair as shown, with a user pressing on the latch devices 32 to detach the tank 30 from the casing 20. Although a pair of latch devices 32 are shown, a single latch device 32 could be present. Moreover, the latch devices 32 are convenient in that they automatically lock the tank 30 to the casing 20, but require a manual pressure on opposite sides of the tank 30 to be unlatched and removed, thereby contributing to the safe use of the device 10. However, other types of latching or locking devices could be used, including standard fasteners such as screws, if the tank 30 is removable. Moreover, a vent, with for example a valve (e.g., check valve) may be provided in the tank 30, such as in an upper portion of the tank 30.

Referring to FIG. 3, the pump 40 is shown as having an inlet 41 and an outlet 42. The pump 40 is typically an electrically powered pump that is in fluid communication with the liquid tank 30 or other fluid source so as to receive a liquid supply therefrom. The pump 40 provides the motive force so as to direct the liquid to the heating unit 50. In an embodiment, as illustrated in the figures, both the liquid tank 30 and the pump 40 are located in the grip 21 of the casing 20. As an alternative to an electric pump, motive force may be provided by other mechanisms, such as a hand pump operated with a trigger to increase a pressure in the tank 30, and force the water out by pressure differential. Other motive force arrangement may include using a pressurized water source feeding a flow of water from outside of the device 10, e.g., a hose connected to a water tap. Hence, the device 10 may not include a pump 40 or motive force source in a variant.

Figure 4:
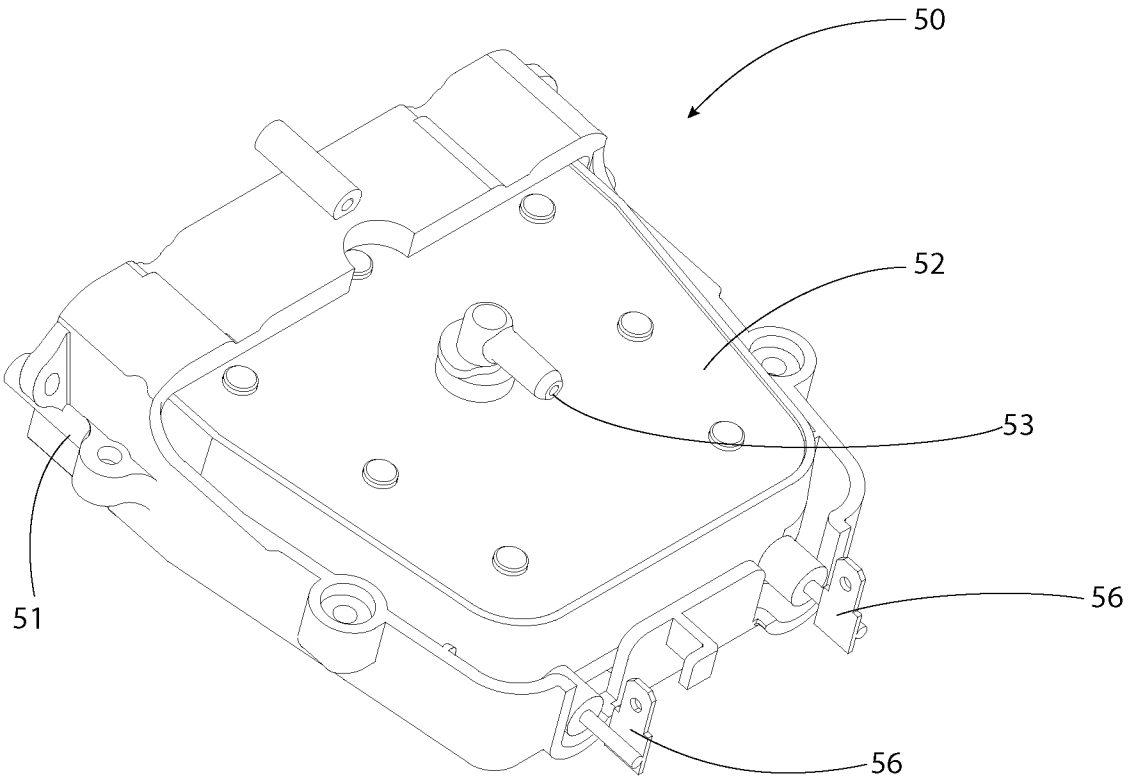
FIG. 4 is a perspective view of a heating unit of the garment steamer device of FIG. 1.
Figure 5:
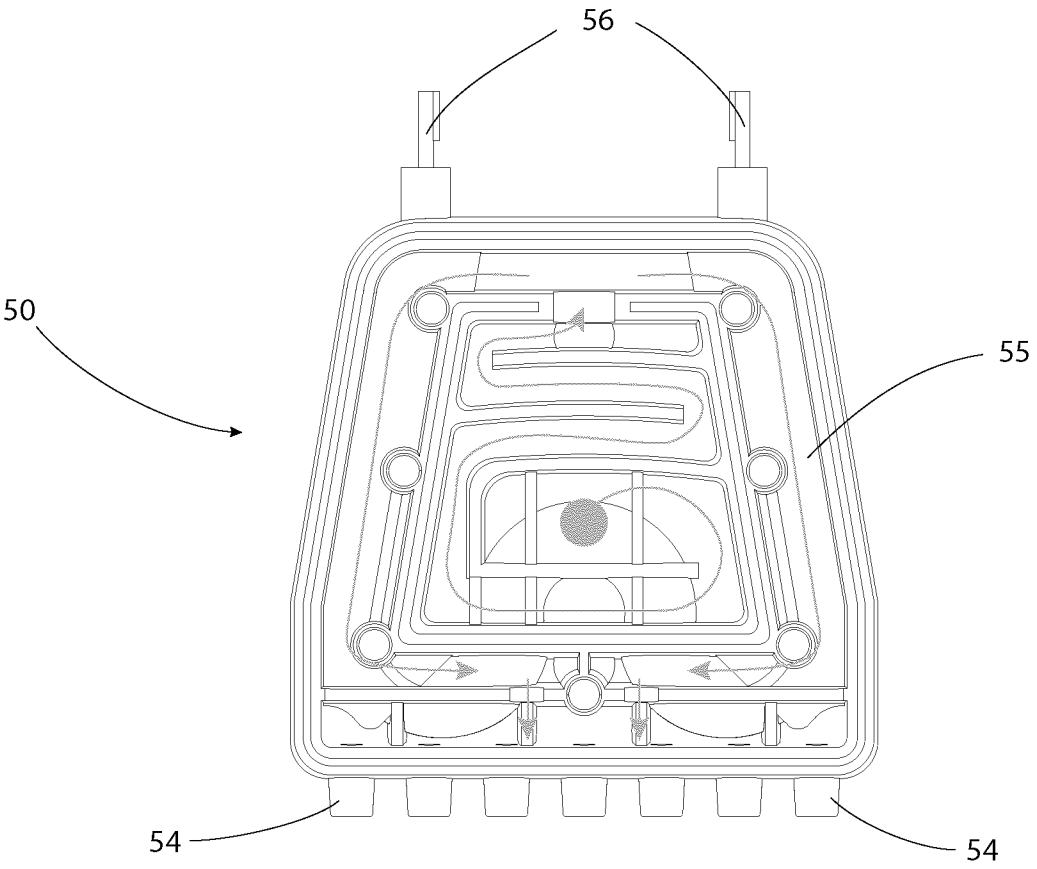
FIG. 5 is a sectioned view of the heating unit of FIG. 4.

Referring now to FIGS. 4 and 5, the heating unit 50 is shown in greater detail. The heating unit 50 is typically lodged into the nozzle portion 22 of the casing 20, in close proximity to the outlet end. The heating unit 50 may be at other locations as well, such as in the handle. The heating unit 50 may have a support 51, though this is optional, supporting a heater 52. The support 51 may also be an integral part of the heater 52. If present, the support 51 may be made of a material that has greater insulative properties than the heater 52. If present, the support 51 interfaces the heater 52 to the casing 20 such that the heater 52 is not in direct contact with the casing 20. Hence, the support 51 may be a heat shield, that could also be part of layers of the heating unit 50. The heater 52 has an inlet 53 and one or more outlet nozzles 54, multiple nozzles 54 being shown in the illustrated version. In yet another embodiment, central axes of the outlet nozzles 54 may all be parallel to one another and all lie in a common plane. Such an arrangement may lead to a flat steam spray. Other configurations are contemplated, such as having different rows of outlet nozzles 54 (e.g., in an array). As another configurations, at least some of the central axes converge toward one another to have a more focused steam spray.

FIG. 5 shows an interior of the heater 52. A heating pathway 55 is defined from the inlet 53 to the outlet nozzles 54. In an aspect, the heating pathway 55 is heated by electrical power (though optionally) such that water entering the inlet 53 moves forward toward the nozzles 54 while being heated. The labyrinth-like configuration, which may also be referred to as coil-like, extends the residence time of the liquid into the heater 52 so as to assist in converting the water into steam. The heater 52 or at least an interior thereof with the heating pathway 55 may be made of metal. In an aspect, the heater 52 has resistive elements so as to convert electrical power into heat. Electrical connections 56 may therefore be electrically connected to the power system 80. As alternatives to a heating pathway 55, the heater 52 may define a hollow chamber traversed by resistive elements acting as heating coils, among possibilities.

Figure 8:
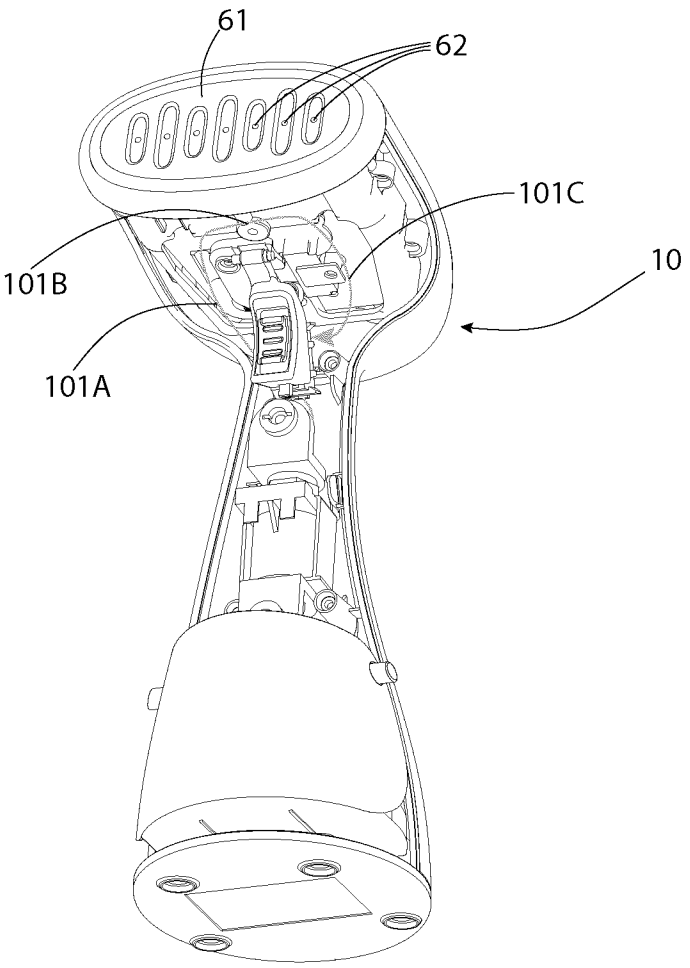
FIG. 8 is another perspective view, partially transparent, showing a location of the cooling segment.

Referring to FIGS. 2 and 8, the outlet head 60 is shown being at the end of the nozzle portion 22 of the casing 20. The outlet head 60 may include a plate 61 that attaches to an opening at the distal end of the nozzle portion 22 of the casing 20. In an embodiment, the plate 61 is made of a plastic or low-heat conductivity material. Consequently, if present, the outlet head 60 may serve a shielding function. Nozzles 62 or like holes may be present and aligned with the outlet nozzles 54 of the heater 52. In an embodiment, the nozzles 62 do not actually perform a jetting function but are barrels that prevent a user from touching the outlet nozzles 54. It is also considered to use the nozzles 62 to assist in directing a steam flow out of the device 10. The outlet head 60 may be optional, as the device 10 may have the heating unit 50 project out of the casing 20, or be exposed at the distal end of the nozzle portion 22.

Referring to FIGS. 2 and 3, the trigger assembly 70 is located at the junction between the grip 21 and the nozzle portion 22. The trigger assembly 70 may have a detent 71, operatively connected to a base 72. The detent 71 may also be known as a trigger. The detent 71 is located at the junction between the grip 21 and the nozzle portion 22 so as to be in close proximity to an index finger of the user. The detent 71 could also be on the grip 21 only or on the nozzle portion 22 only. The user may therefore "pull the trigger" 71. A pressure on the detent 71 will cause it to pivot or move relative to the base 72. The appropriate electronic circuitry, such as by way of an on/off switch, is present in the trigger assembly 70 so as to cause an actuation of the pump 40 when the trigger 71 is activated, or cause an actuation of the motive force, allow a flow of water (e.g., trigger 71 connected to an on/off valve), etc if there is no pump 40. The pump 40 will therefore pump liquid from the tank 30 or other source and direct it to the heating unit 50. In doing so, a pressure inside the heater 52 increases and this causes steam to outlet via the outlet nozzles 54. In an embodiment, the heater 52 is in a heating mode the moment the device 10 is turned on, but it is also contemplated to require that the trigger 71 be depressed to turn the heater 52 on.

In an embodiment, there is no trigger assembly 70 in the hand-held device 10. For example, the device 10 may be used with a pedal that is pressed to control a feed of water to the heating unit 50. In such an embodiment, the device 10 may be without tank 30 and without pump 40. Such a system may rely on tap water pressure to direct water to the heating unit 50.

Referring to FIG. 3, some of the components of the power system 80 are shown. An electrical cord portion 81 is at a tail end of the grip 21. In an embodiment, a power cord extends from the garment steamer device 10 to a power source such as the grid, as an example among others. Battery power could also be used, and port(s) may be present to recharge the battery. A power button 82 is optionally present with at least an on/off capability, so as to activate the garment steamer device 10. In an embodiment, an on state via the power button 82 will automatically cause an actuation of the heating unit 50. In contrast, the pump 40 may be in an idle state until the trigger assembly 70 is used by a user.

A printed circuit board 83 of the power system 80 may be located at a bottom of the casing 20 or may be at other locations. The PC board 83 or like circuit card, processor, etc is present in order to manage the commands of the garment steamer device 10. The PC board 83 may include other features such as sensors, an interface, etc. The PC board 83 may therefore perform functions such as managing electric current, preventing overheating, automatically shutting down the device 10, provide water level indications, etc.

Referring to FIG. 3, various water conduits are present in order to direct liquid from the tank 30 to the heating unit 50. A water conduit shown as 100, also known as a pipe, a tube, tubing, channel, etc., is in fluid communication with the tank 30 and more particularly with the feed tube 31 if present. As mentioned above, the water conduit 100 may have its intake directly in the tank 30 or may be connected to a liquid source (e.g., tap). Other components may be present such as a check valve, the check valve preventing liquid from returning to the tank 30. The water conduit 100 extends to the inlet 41 of the pump 40, and is in fluid communication with the pump 40.

Another water conduit is shown as 101, but could also be an extension of the water conduit 100. The water conduit 101 extends from the pump 40 to the heating unit 50. More particularly, the water conduit 101 is in fluid connection with the outlet 42 of the pump 40 and with the inlet 53 of the heating unit 50. It is observed from FIGS. 3, 7, 8 and 9 that the water conduit 101 passes through a volume V defined between a wall of the casing 20 and the heating unit 50. On passing through the volume V, it may be said that the water conduit 101 detours, in that it takes a longer route than if it were to go straight to the heater 52. Stated differently, the water conduit 101 does not take a shortest passage to reach the heater 52, being directed instead to a thermal barrier zone, i.e., being detoured to the thermal barrier zone. That wall is an outer wall that is shown as 22B and is part of the nozzle portion 22, with the volume V being adjacent to the grip 21, for example between the segment of the nozzle portion 22 between the grip 21 and the distal end of the nozzle portion 22 (i.e., where the outlet head 60 is, if present). Therefore, during use, the user's index is in close proximity to this wall 22B as the user's index manipulates the detent 71. Practically speaking, the user's index is at a distance of <1.5 in of the heater 52. The water conduit 101 defines a hoop in the volume V (FIG. 9), by being lodged between the pairs of fingers 25. The water conduit 101 may have different circuit patterns, including coils, spiral, etc. Accordingly, the spacing between the pairs of fingers 25 is such that the water conduit 101 is held captive between the fingers 25.

By having the water conduit 101 in the volume V, the water conduit 101 forms a heat sink that absorbs heat from the heater 52, whereby by radiation, conduction and/or convection. The water conduit 101 is shown as having cooling segments 101A, 101B and 101C, forming a single pass. Segment 101A extends from the outlet 42 of the pump 40 and goes toward the distal end of the nozzle portion 22. Segment 101B is a bend that is generally parallel to a pivoting axis of the trigger assembly 70, if the trigger 71 is pivotable. Segment 101C redirects the water conduit 101 toward the rear end and up onto the inlet 53 of the heating unit 50. While a single pass is shown, it is considered to have more than one pass, for example by providing a greater length of water conduit 101 and/or more fingers 25.

As another possibility, water channels are defined directly in the shell 20B of the casing 20, with another complementary component, such as a cap, contributing to forming the channels. Such channels may extend directly from the pump 40 to the heating unit 50, or may be in fluid communication with these components by conduits. Therefore, water circulates in the volume V, from the pump 40 to the heater 52. The water circulating the volume V, for instance via the water conduit 101 in the illustrated configuration, is for instance at room temperature, as the water is not heated in the tank 30 or in the pump 40. As another possibility, the water conduit 101 has a bladder, pool or like small reservoir between segment 101A and segment 101C.

Therefore, when the heater 52 is activated, water is typically present in the water conduits 100 and 101. Water in the water conduit 101 will therefore absorb ambient heat resulting from the actuating of the heater 52. The water conduit 101 acts as a heat-absorbing thermal barrier, a heat sink, a heat exchanger, a shield. In some instances, the water conduit 101 may cool the wall of the casing 20, for instance in on/off sequences of the garment steamer device 10. Then, as the garment steamer device 10 is activated, the water in the conduit 101 will move to the heater 52, and colder water from the tank 30 will fill the conduit 101, resulting in an increased heat absorbing capacity due to a greater temperature gradient. Moreover, as the water in the conduit 101 may have absorbed heat in the conduit 101, the water fed to the heater 52 is warmer. Therefore, the energy loss of the device 10 may be reduced as some heat is recuperated in the conduit 101, i.e., heat reclaim. The device 10 with the cooling feature of the conduit 101 may be said to be more energy efficient than a device without the cooling feature.

Still referring to FIG. 9, the volume V may be said to enclose or define a pre-heating zone, in which the water from the pump 40 is pre-heated before being fed to the heating unit 50. The pre-heating zone concurrently forms a heat absorbing pad, thermal barrier, or cooling feature, between the heater 52 and the handling zone H, also known as trigger zone, where the trigger 71 is located. The volume V may also include insulating materials in free spaces around the water conduit 101 or like water channels. In an embodiment, a distance between the heater 52 and a wall of the casing 20 is as low as 0.125", and may be between 0.125" and 0.5", inclusively.

In an aspect, as an alternative or in addition to multiple passes of the water conduit, a diameter of the water conduit 101 may be increased in relation to the water conduit 100 to ensure that a greater amount of water is present. Moreover, the arrangement of the water conduit 101 may be in the form of a trap, to ensure that water is kept in the water conduit 101 by gravity, such that the cooling feature may be continuously present. In another aspect, for the cooling feature to be continuously present, components such as a check valve or like valve may be present downstream of the pump 40 but upstream of the cooling feature. In yet another aspect, instead of a conduit or channel, a water reservoir is present in the volume V, with water passing through the reservoir from the pump 40 to the heating unit 50. The reservoir may be connected at an outlet 42 to the pump 40 via a conduit, and may be connected to an inlet 53 of the heating unit 52 by another conduit. In another aspect, the conduit 101 may be said to be a reservoir.

In the embodiments shown, the heater 52 and the cooling feature of the conduit 101 are in the nozzle portion 22. However, the heater 52 may be in the grip portion 21 (including a base). In such a case, conduits may extend from the heater 52 to the nozzle portion 22 to output steam. In such an arrangement, the conduit 101 may be between the heater 52 and the wall of conduit portion 21. The conduit 101 could also extend along the pipes from the heater 52 to the outlet head 60.

Figure 11:
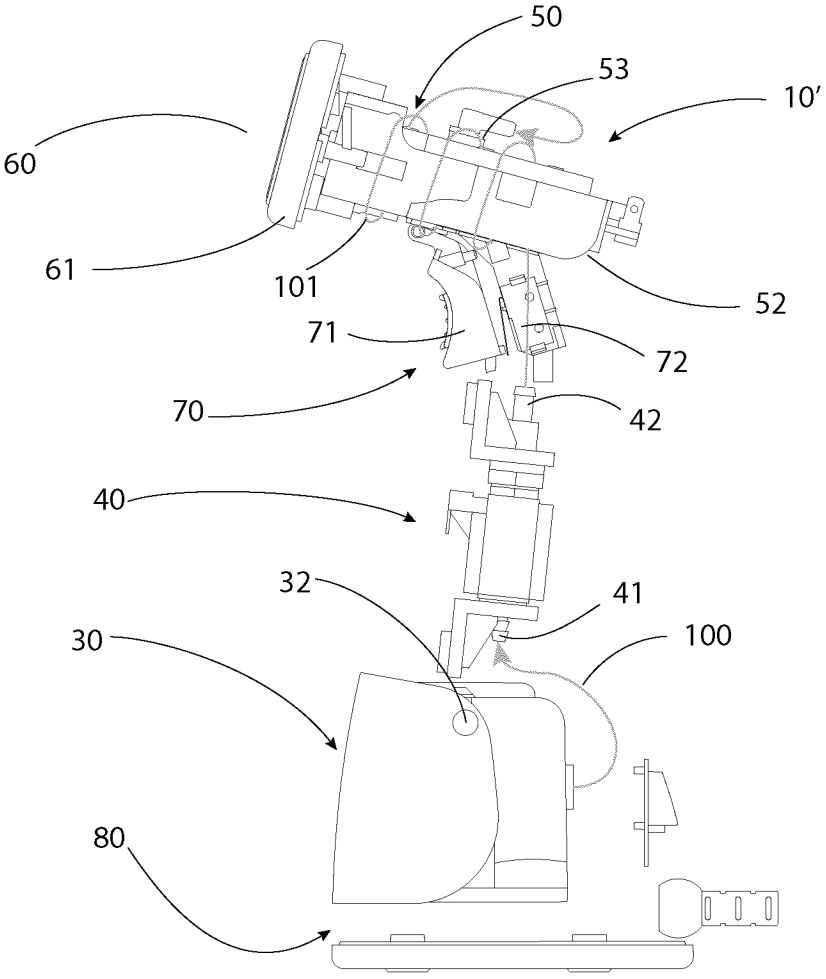
FIG. 11 is an assembly view of components of the garment steamer device of FIG. 1, with a casing thereof removed, and with a variant of the cooling feature.
Figure 12:
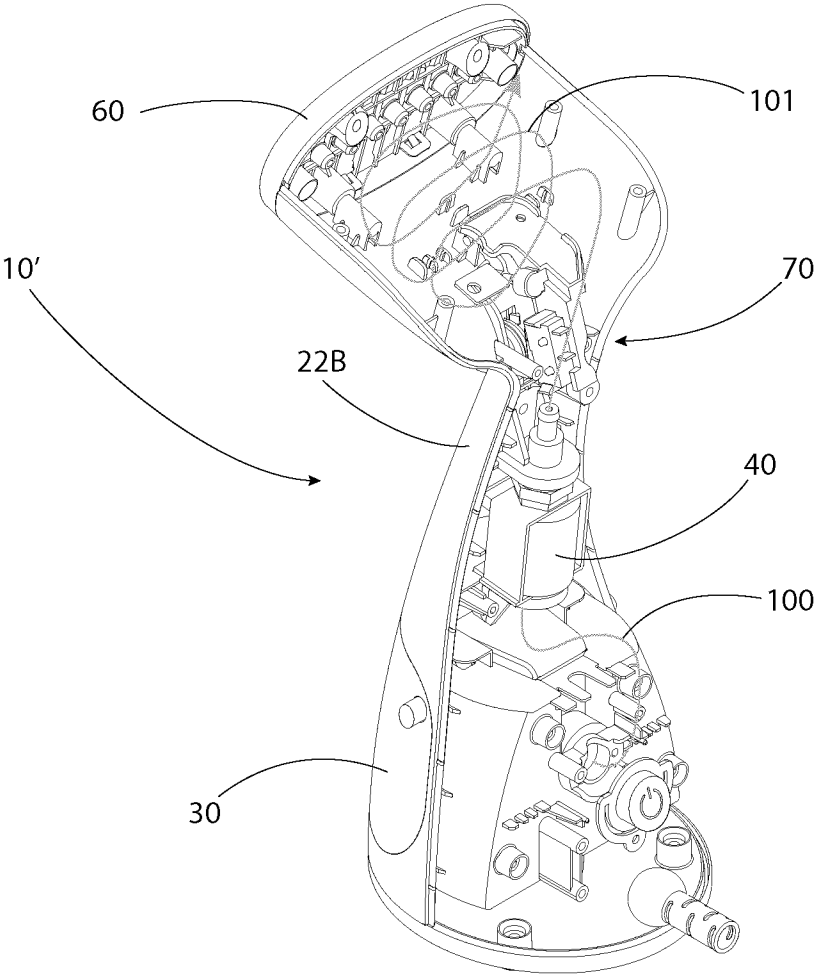
FIG. 12 is a perspective view of the garment steamer device of FIG. 11, with a shell of the casing removed.

Referring to FIGS. 11-12, a variant of the garment steamer device 10 is shown, as 10'. The garment steamer device 10' is similar in configuration to the garment steamer device 10 of FIGS. 1-10, and may include any of the afore-discussed configurations of the garment steamer device 10. For simplicity, components of the garment steamer device 10 present in the garment steamer device 10' are shown with the same reference numerals in the figures. The description provided above for the garment steamer device 10 of FIGS. 1-10 applies to the garment steamer device 10'.

As observed from FIGS. 11 and 12, a difference in the garment steamer device 10' is the arrangement of the conduit 101. In the garment steamer device 10', the conduit 101 forms a spiral surrounding the heater 52. Therefore, the pre-heating zone, concurrently forming heat absorbing pad, thermal barrier, or cooling feature, is annular- or sleeve-like in shape, surrounding the heater 52, and filling an annular space between the heater 52 and the casing 20. While not in proximity to the trigger 71, a top of the device 10' also benefits from the presence of circulating water. Alternative configurations may also be used, including bladder(s). As an alternative to spirals, the configuration of hoop shown in FIG. 10 could be repeated on a top of the heater 52, with one or multiple passes. In FIG. 12, the heating unit 50 was removed to show the exemplary spiral arrangement of the conduit 101.

Figure 13:
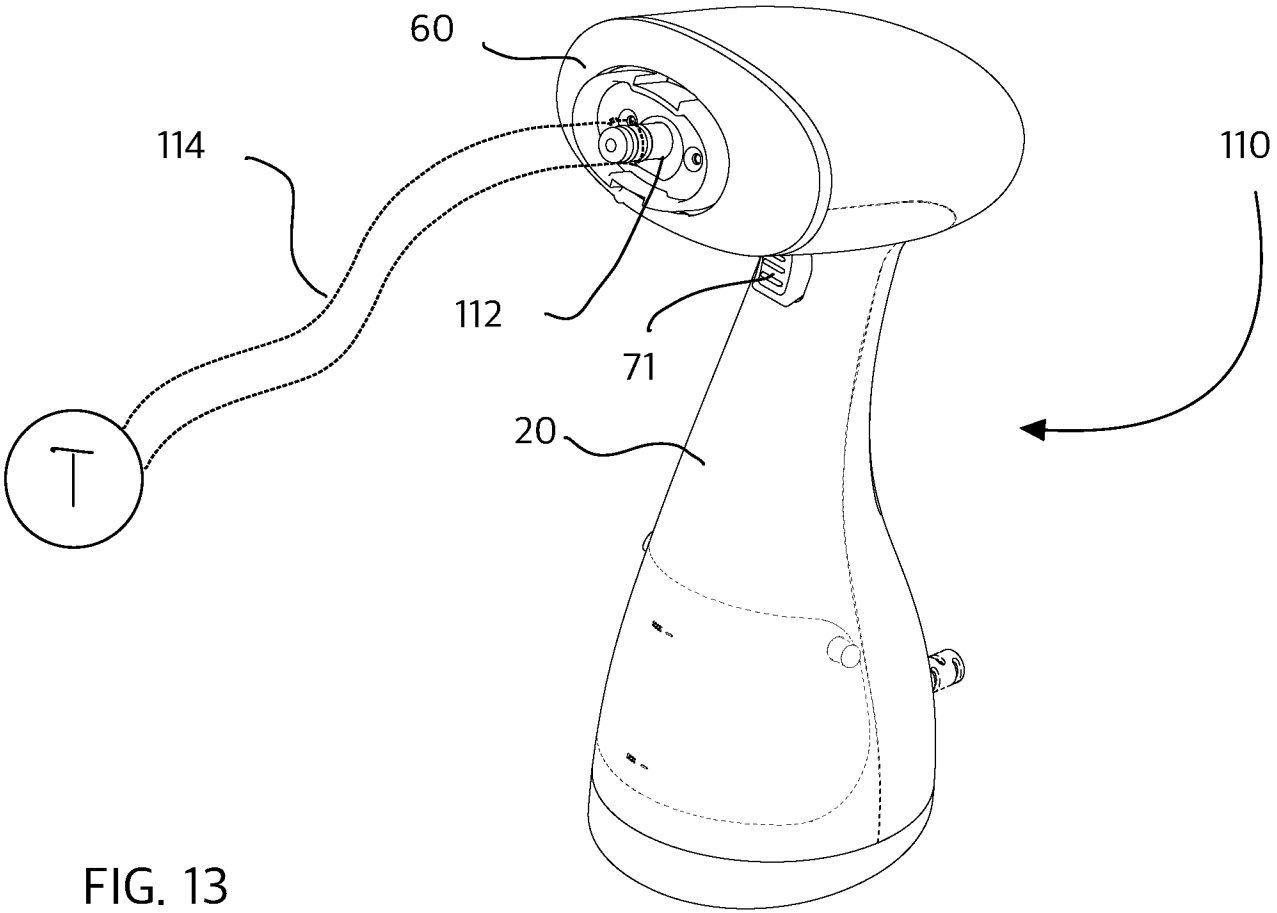
FIG. 13 is a perspective view of a portable steamer device in accordance with the present disclosure.
Figure 14:
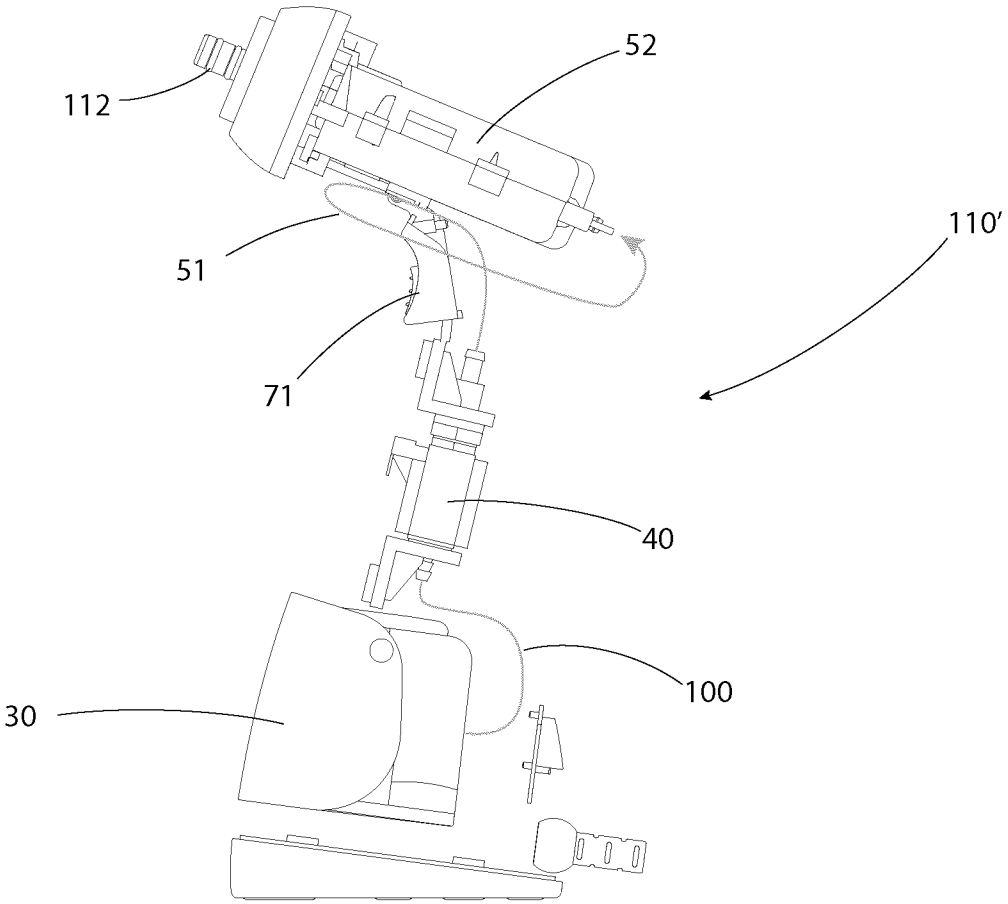
FIG. 14 is an assembly view of components of the portable steamer device of FIG. 13, with a casing thereof removed.

Referring to FIGS. 13 and 14, a portable steamer device is shown, as 110. The portable steamer device 110 is similar in configuration to the garment steamer device 10 of FIGS. 1-10, and may include any of the afore-discussed configurations of the garment steamer device 10. For simplicity, components of the garment steamer device 10 present in the portable steamer device 110 are shown with the same reference numerals in the figures. The description provided above for the garment steamer device 10 of FIGS. 1-10 applies to the portable steamer device 110.

As observed from FIGS. 13 and 14, a difference in the garment steamer device 10' is the presence of a single outlet nozzle, shown as 112. The single outlet nozzle 112 may be part of the heater 52, or may be part of the outlet head 60. The outlet nozzle 112 may be a nipple like formation that projects forwardly from a end of the nozzle portion 22. In an embodiment, the nozzle 112 is part of the outlet head 60, and is in fluid communication with a nozzle at the outlet of the heater 52. The outlet head 60 may then be replaced to have other sizes of nozzle 112, for various applications or uses. For example, the nozzle 112 may be connected to a hose, schematically shown at 114, to feed steam to another device or tool shown as T. The device or tool T may be of any type, such as a squeegee, a cleaning head, etc. In an embodiment, a user has one hand on the portable steamer device 110, and another hand on the tool T.

The portable steamer device 110 also has the water conduit 101 forming a heat sink that absorbs heat from the heater 52, whereby by radiation, conduction and/or convection, in the same possible arrangements as described for the garment steamer device 10 of FIGS. 1-10. Therefore, when the heater 52 is activated, water is typically present in the water conduits 100 and 101. Water in the water conduit 101 will absorb ambient heat resulting from the actuating of the heater 52. The water conduit 101 acts as a heat-absorbing thermal barrier, a heat sink, a heat exchanger, a shield.

Figure 15:
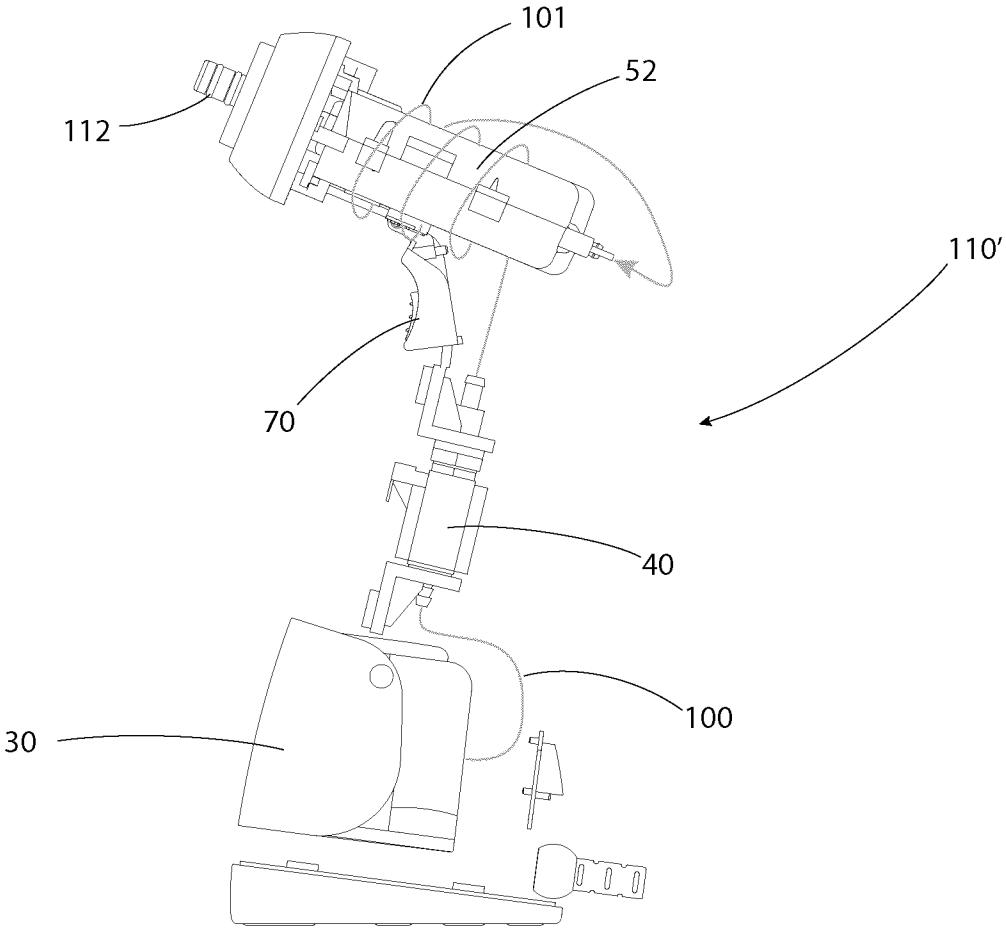
FIG. 15 is an assembly view of components of the portable steamer device of FIG. 13, with a casing thereof removed, with another variant of the cooling feature.
Figure 16:
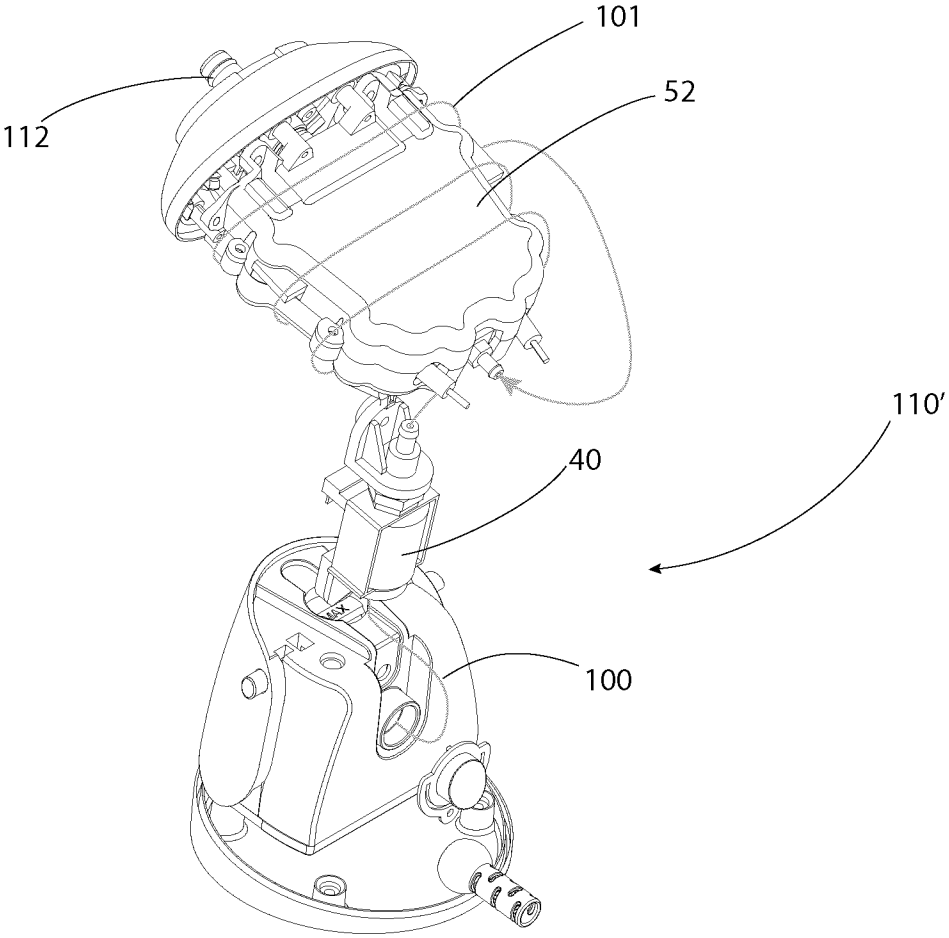
FIG. 16 is a perspective view of the portable steamer device of FIG. 15, with a shell of the casing removed.

Referring to FIGS. 15-16, a variant of the portable steamer device 110 is shown, as 110'. The portable steamer device 110 is similar in configuration to the garment steamer device 10 of FIGS. 1-10 and to the portable steamer device 110 with its single outlet 112, and may include any of the afore-discussed configurations of the garment steamer device 10 and/or of the portable steamer device 110. For simplicity, components of the garment steamer device 10 and of the portable steamer device 110 present in the portable steamer device 110' are shown with the same reference numerals in the figures. The description provided above for the garment steamer device 10 of FIGS. 1-10 and for the portable steamer device 110 applies to the portable steamer device 110'.

As observed from FIGS. 15 and 16, a difference in the portable steamer device 110' is the arrangement of the conduit 101. In the portable steamer device 110', the conduit 101 forms a spiral surrounding the heater 52. Therefore, the pre-heating zone, concurrently forming heat absorbing pad, thermal barrier, or cooling feature, is annular- or sleeve-like in shape, surrounding the heater 52, and filling an annular space between the heater 52 and the casing 20. While not in proximity to the trigger 71, a top of the device 110' also benefits from the presence of circulating water. Alternative configurations may also be used, including bladder(s). As an alternative to spirals, the configuration of hoop shown in FIG. 10 could be repeated on a top of the heater 52, with one or multiple passes.

Figure 17A:
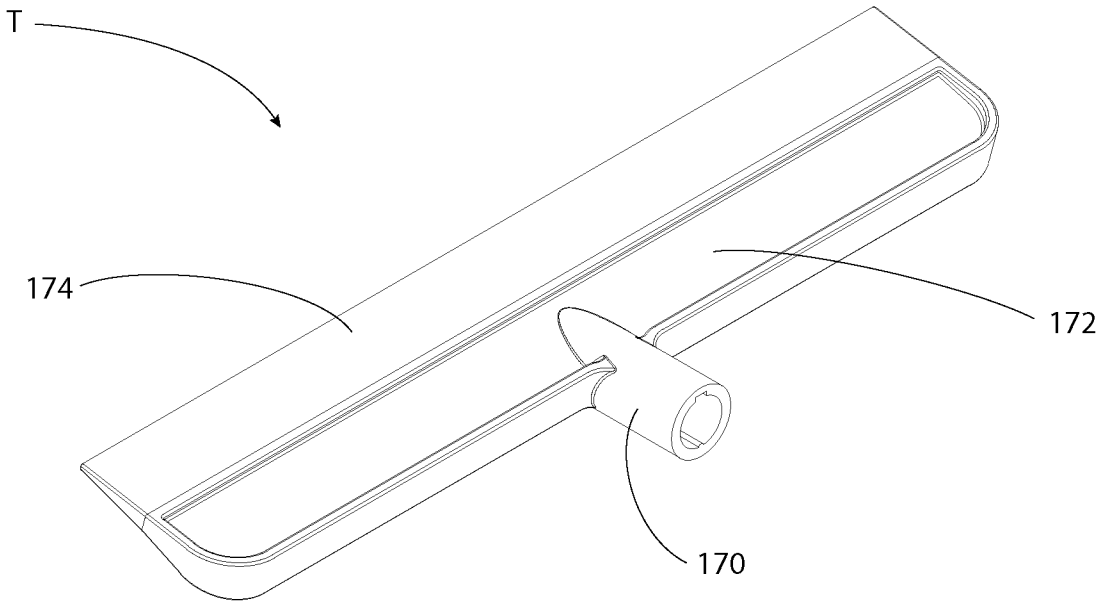
FIG. 17A is a first perspective view of a squeegee accessory that may be used with the portable steamer device of FIGS. 13-16.
Figure 17B:
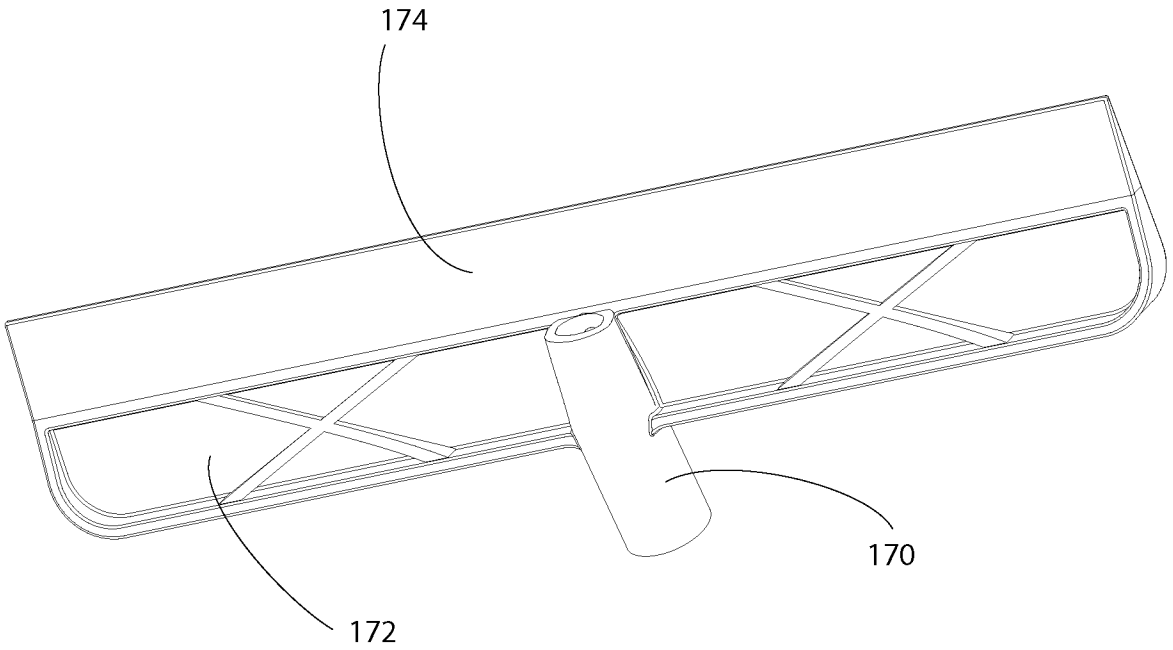
FIG. 17B is a second perspective view of the squeegee accessory of FIG. 17A.

Exemplary tools T are shown in FIGS. 17A-19B, and may be configured to be used with the portable steamer device 110 and/or the portable steamer device 110'. In FIGS. 17A and 17B, the tool T is a squeegee having a coupling tube 170 connected to a bar 172, with a wiper 174 on an edge of the bar 172. The coupling tube 170 may for example be coupled to the outlet nozzle 112 of the steamer device 110,110', directly of via hose 114, such that steam may exit near the wiper 174.

Figure 18A:
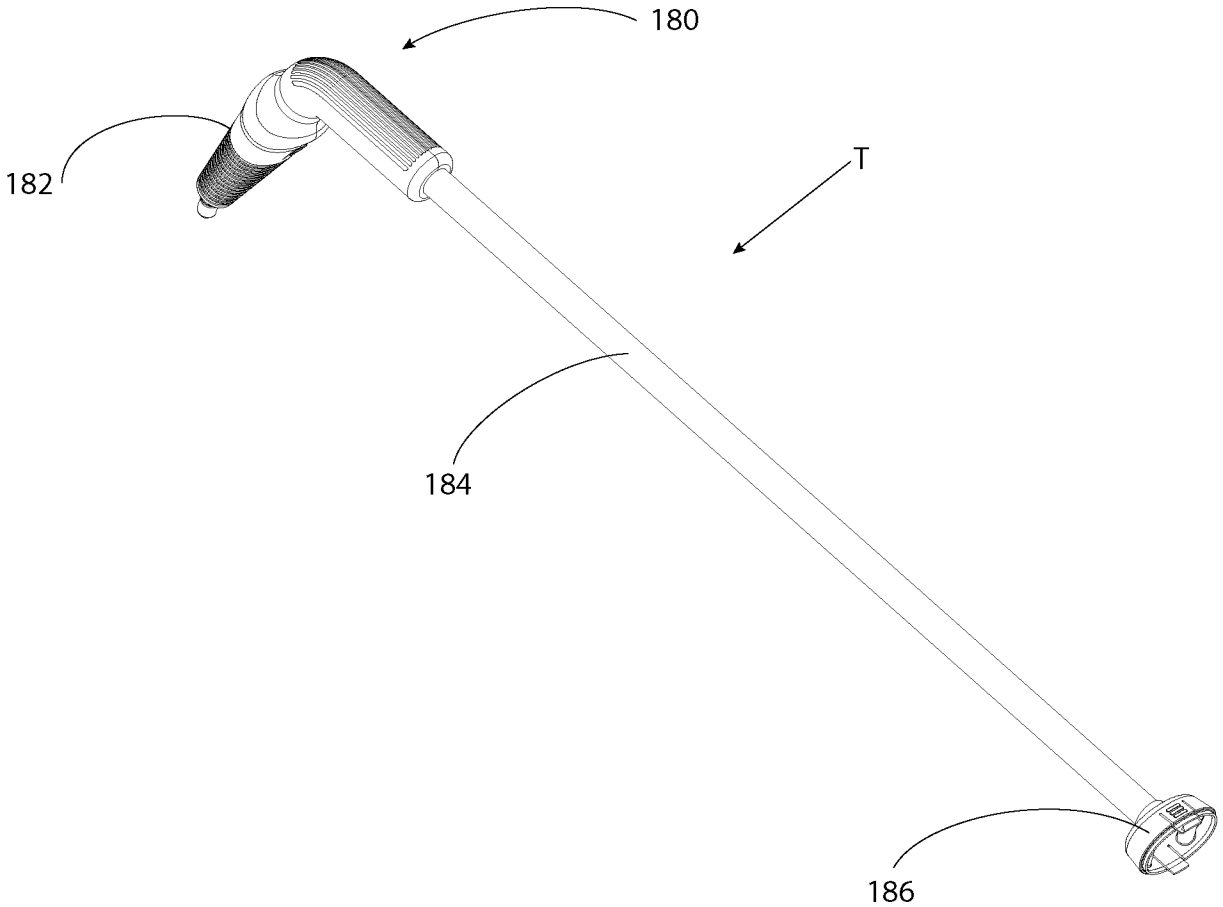
FIG. 18A is a first perspective view of a lance accessory that may be used with the portable steamer device of FIGS. 13-16.
Figure 18B:
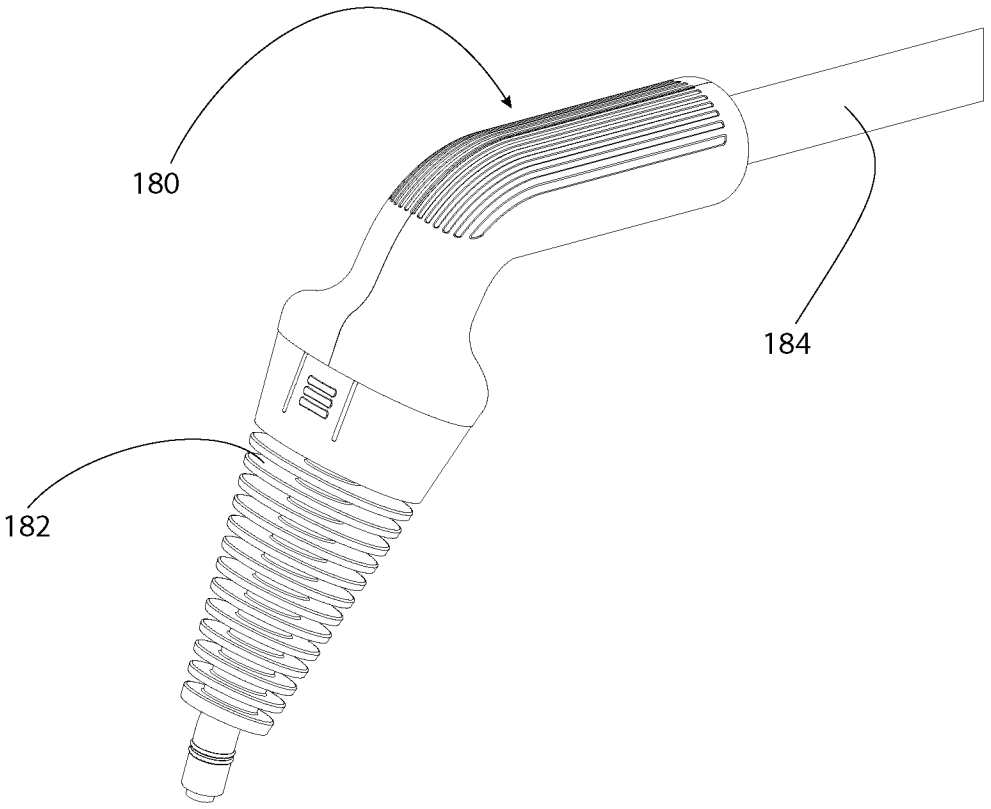
FIG. 18B is a second perspective view of the lance accessory of FIG. 18A.

In FIGS. 18A and 18B, the tool T is a lance 180 having a gun-shaped figure with an outlet nozzle 182 being elongated in shape. For example, as shown, the outlet nozzle 182 may be equipped with cooling fins. The outlet nozzle 182 may be removably attached to the portable steamer device 110, 10', i.e., without a grip and thus not as part of a gun-shaped figure. Alternatively, as shown, the lance 180 has its gun shape from a grip, and a hose 184 connects the lance 180 to the portable steamer device 110,110', via a coupling member 186. The outlet nozzle 182 may serve as an extension to provide more length to the portable steamer device 110,110'. Other tools may be connected to the outlet nozzle 182.

Figure 19A:
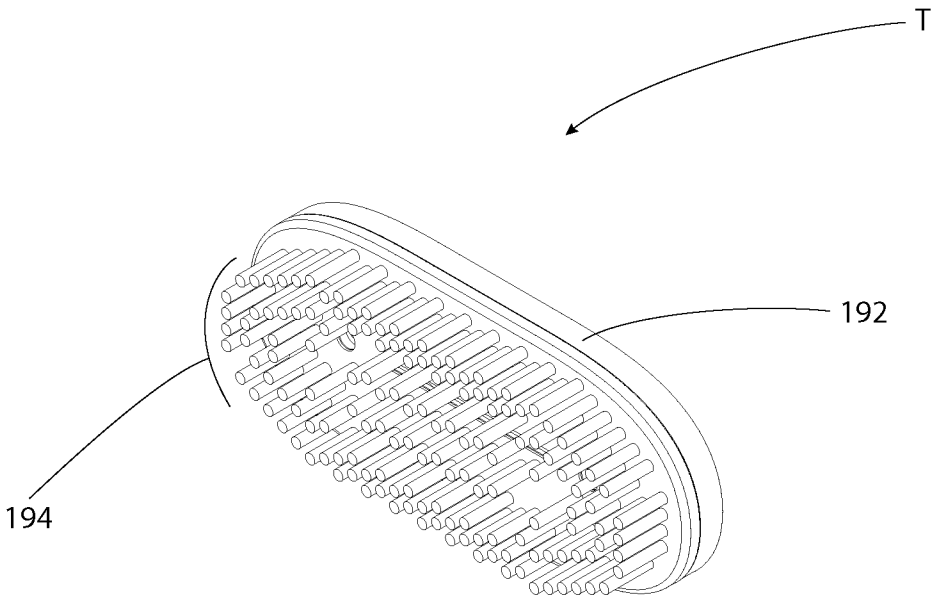
FIG. 19A is a first perspective view of a brush accessory that may be used with the portable steamer device of FIGS. 13-16.
Figure 19B:
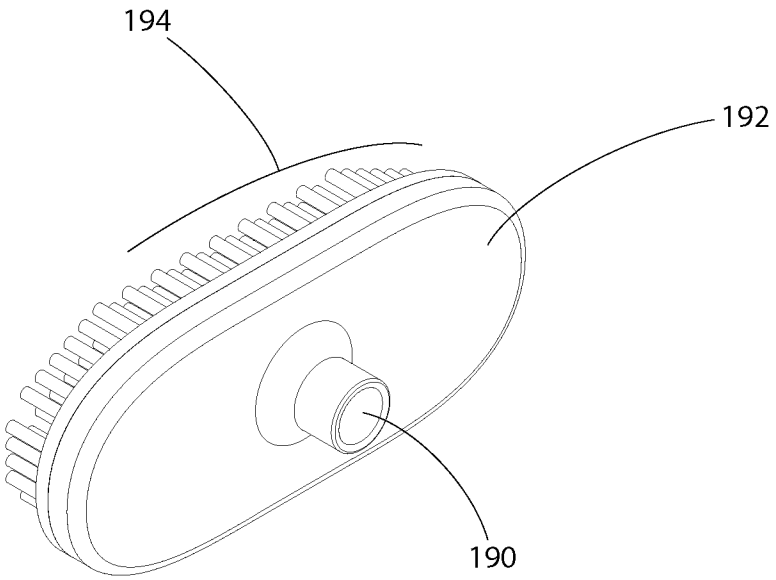
FIG. 19B is a second perspective view of the brush accessory of FIG. 19A.

In FIGS. 19A and 19B, the tool T is a brush having a coupling tube 190 connected to a body 192. Bristles or like brushing components 194 may project from a face of the body 192. The coupling tube 190 may for example be coupled to the outlet nozzle 112 of the steamer device 110,110', such that steam may exit near the bristles 194. It is also contemplated to connect the brush to the portable steamer device 110,100' with a hose, such as hose 114.

In an embodiment, applicable to any of the devices described herein (e.g., 10, 10', 110, 110'), at least 50% of the total length of the water conduit 101, from the pump 40 to the heater 52 is detoured from a shortest path between the pump 40 and the heater 52. In an embodiment, at least 50% of the total length of the water conduit 101, from the pump 40 to the heater 52, is in the volume V. In an embodiment, at least 60% of the total length of the water conduit 101, from the pump 40 to the heater 52, is in the annular chamber around the heater 52, in the devices 10' and 110'. In variants, the cooling segment of the water conduit 101 is at least 50% of the total length of the water conduit 101, from the pump 40 to the heater 52.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A portable steamer device comprising:

a casing, a heater in the casing, the heater configured for heating liquid into steam, at least one nozzle, the at least one nozzle configured for exhausting steam from the heater, a volume defined between a wall of the casing and the heater, and a liquid conduit having a cooling segment passing through the volume and in fluid communication with the heater, the liquid conduit configured to feed liquid to the heater, whereby the cooling segment of the liquid conduit is a thermal barrier configured to capture heat in the volume with liquid passing through the liquid conduit toward the heater.

2. The portable steamer device according to claim 1, wherein the casing defines a grip and a nozzle portion.

3. The portable steamer device according to claim 2, wherein the volume is substantially located in the nozzle portion.

4. The portable steamer device according to claim 3, including a detent projecting from the casing and actuatable to cause a liquid flow in the liquid conduit.

5. The portable steamer device according to claim 4, wherein the detent is mounted to the grip of the casing.

6. The portable steamer device according to claim 4, wherein the volume is above a zone located forward of the detent.

7. The portable steamer device according to claim 1, further including a pump in the casing, the liquid conduit being between the pump and the heater.

8. The portable steamer device according to claim 7, wherein the cooling segment defines at least 50% of a total length of the liquid conduit.

9. The portable steamer device according to claim 1, wherein the cooling segment forms a hoop.

10. The portable steamer device according to claim 1, wherein the volume is around the heater, and the cooling segment surrounds the heater.

11. The portable steamer device according to claim 1, wherein a distance between the wall and the heater at the volume is between 0.125" and 0.5".

12. The portable steamer device according to claim 1, further including a reservoir.

13. The portable steamer device according to claim 12, wherein the reservoir is releasably detachable from the casing.

14. The portable steamer device according to claim 1, including a plurality of the at least one nozzle arranged in at least one row.

15. The portable steamer device according to claim 1, including plate covering the at least one nozzle.

16. The portable steamer device according to claim 1, wherein the portable steamer device is a garment steamer device.

17. The portable steamer device according to claim 1, including a single one of the nozzle, the single one of the nozzle configured for attachment of an accessory.

18. A method for operating a portable steamer device comprising:

actuating a heater configured to heat liquid into steam;

supplying liquid to the heater, wherein supplying liquid to the heater includes passing the liquid through a volume located between the heater and an outer wall of the portable steamer device for liquid to reclaim heat from the heater; and exhausting steam from the heater.

19. The method according to claim 18, wherein passing the liquid through the volume includes circulating liquid in a segment of a liquid conduit.

20. A portable steamer device comprising:

a casing, a heater in the casing, the heater configured for heating liquid into steam, at least one nozzle, the at least one nozzle configured for exhausting steam from the heater, a volume defined between a wall of the casing and the heater, and a liquid conduit having a cooling segment passing through the volume and in fluid communication with the heater, the liquid conduit configured to feed liquid to the heater, whereby the cooling segment of the liquid conduit is a thermal barrier configured to capture heat in the volume with liquid passing through the liquid conduit toward the heater, wherein the cooling segment of the liquid conduit of the liquid conduit passes liquid through the volume, and wherein the cooling segment of the liquid conduit is disposed below the heater.

* * * * *